United States Patent [19]

Beimgraben

[11] Patent Number: 4,560,013

[45] Date of Patent: Dec. 24, 1985

[54] APPARATUS FOR DIRECTIONAL DRILLING AND THE LIKE OF SUBTERRANEAN WELLS

[75] Inventor: Herbert W. Beimgraben, Houston, Tex.

[73] Assignee: Baker Oil Tools, Inc., Orange, Calif.

[21] Appl. No.: 580,946

[22] Filed: Feb. 16, 1984

[51] Int. Cl.[4] ..... E21B 7/08

[52] U.S. Cl. ..... 175/73; 175/325

[58] Field of Search ..... 175/73, 76, 325

[56] References Cited

U.S. PATENT DOCUMENTS

| | | | |
|---|---|---|---|
| 4,015,673 | 4/1977 | Craig, Jr. et al. | 175/73 |
| 4,076,084 | 2/1978 | Tighe | 175/73 |
| 4,080,010 | 3/1978 | Young | 175/76 |
| 4,319,649 | 3/1982 | Jeter | 175/73 |
| 4,465,147 | 8/1984 | Feenstra et al. | 175/73 |

*Primary Examiner*—Stephen J. Novosad
*Assistant Examiner*—William P. Neuder
*Attorney, Agent, or Firm*—Norvell & Associates

[57] ABSTRACT

Apparatus for effecting a minute change in the direction of a downhole rotary tool comprises an eccentric cylindrical surface formed on the housing of a downhole motor or a member connected between the motor and the tool, which is received within an eccentric bore of a stabilizer housing, the periphery of which snugly engages the walls of, for example, the newly drilled well bore. Selective angular adjustment of the eccentric stabilizer housing relative to the eccentric surface provided on or adjacent to the motor housing effects a desired shift in angular position of the rotary tool to effect a desired change in the direction of the selected activity, such as drilling.

7 Claims, 8 Drawing Figures

APPARATUS FOR DIRECTIONAL DRILLING AND THE LIKE OF SUBTERRANEAN WELLS

BACKGROUND OF THE INVENTION

1. Field of the Invention

This invention relates to a device which can be incorporated in a drill string for effecting a change in direction of a rotary drill bit relative to the existing bore of a subterranean well.

2. Description of the Prior Art

The changing of the direction of drilling of the bore of a subterranean well is an expedient long practiced by well drillers. In many instances the change in direction is to produce a straightening of the well due to the deflection of the rotary drill from the desired direction by a particular rock strata. In other instances the change in direction is intentional in order to reach a formation that is laterally displaced from the existing location of the bore hole.

One of the most common expedients for changing the direction of drilling has been the insertion in the drilling or work string, at a point above a downhole motor which drives the rotary drill bit, an apparatus which is called a bent sub. Such bent subs are rigidly connected at one end to the work string and have their other connecting end angularly disposed relative to the axis of the work string to which they are connected, so that when the motor and supported drill bit are rigidly connected thereto, the axis of the drill bit will be angularly inclined relative to the axis of the well bore existing prior to insertion of the bent sub.

Because the change in angle has heretofore been accomplished at a substantial distance above the rotary drill bit, particularly with the class of motors known as "turbines", which by design are relatively long, a large degree of interference has been created between the bent sub and the rotary drill bit and the well bore wall as the work string was lowered in the hole to where the drilling would begin. Additionally, to effect a desired change in angle, which generally is on the order of a fraction of a degree, it was necessary to remove the motor and drill bit from the end of the work string and insert a particular bent sub which had the desired angular deviation incorporated therein. This required the maintenance at the drilling site of an inventory of bent subs having different deviation angles.

A lesser known method for changing the direction of drilling, but an effective one, particularly with the aforementioned long turbine motors has been the incorporation of an eccentric stabilizer on the lower end of said turbines. This method is well documented by a presentation at the 1979 Drilling Technology Conference, Denver, Col. in a paper titled "Turbo-Drilling Deviated Holes In Abu Dhabi" and a more recent article published in the October, 1982 issue of Journal of Petroleum Technology titled "Kicking Off In Large Diameter Holes". This method has removed some of the interference problems of the bent sub but has required a large inventory of fixed, offset axis stabilizers, and has not addressed the problem of easily changing the amount of offset of the stabilizer depending on the current drilling and rig conditions.

There is therefore a recognized need in the well drilling industry for an apparatus which will permit a selected change in the drilling direction to be effected without the large degree of interference mentioned above and, secondarily, without having to maintain a large inventory of fixed offset stabilizers.

SUMMARY OF THE INVENTION

This invention provides an improved apparatus for changing the direction of a rotary tool powered by a downhole motor, such as a drilling tool, by a pre-determined selected minute amount, determined by the amount of offset of a stablizer housing which is mounted on the body of the downhole motor or member associated therewith. An eccentric external surface is provided which cooperates an eccentric bore formed in the stabilizer housing. Both the eccentric external surface and the eccentric bore have surfaces having a common axis that is slightly displaced from the centerline axis of rotation of the fluid pressure motor. The external surface of the stabilizer housing is cylindrically formed about the aforementioned offset axis and cooperates with the previously formed bore hole to shift the direction of the rotary drilling tool.

Angular adjustment of the stabilizer housing relative to the body will produce a shifting of the axis of the fluid pressure motor, hence of the rotary drilling tool, ranging from zero to two times the offset distance of the eccentric axis of the stabilizer housing relative to the common axis of the motor and rotary drilling tool, and thus effectively shift the direction of the rotary drilling tool by a predetermined minute angular amount dependent upon the selected angular displacement of the aforementioned stabilizer housing and torque transmitting element.

The two angularly adjustable elements could obviously be secured in any selected angular position by set screws, but this is an undesirable means of effecting such securement. In accordance with one modification of the invention, the cooperating eccentric male and female surfaces of the stabilizer housing and the body member are provided with cooperating threads and radial shoulders which are respectively brought into abutting engagement by the full threaded engagement of the cooperating threads. Any selected angular displacement of the two threadably engaged elements may then be achieved by inserting a selected number of thin annular shims between the abuttable radial surfaces respectively provided on the stablizer housing and the torque transmitting element.

In another embodiment of the invention, the cooperating eccentric male and female surfaces of the stabilizer housing and the body member are respectively provided with a plurality of peripherally spaced, axially extending, cooperating splines and grooves so that the stabilizer housing may be selectively positioned in the desired angular relationship with respect to the body member. A locking sleeve may then be threadably applied to one of the cooperating elements to prevent relative axial movements of the stabilizer housing with respect to the body member.

Further advantages of the invention will be readily apparent to those skilled in the art from the following detailed description, taken in conjunction with the annexed sheets of drawings, on which are shown two embodiments of the invention.

DESCRIPTION OF THE PREFERRED EMBODIMENTS

Figure 1:
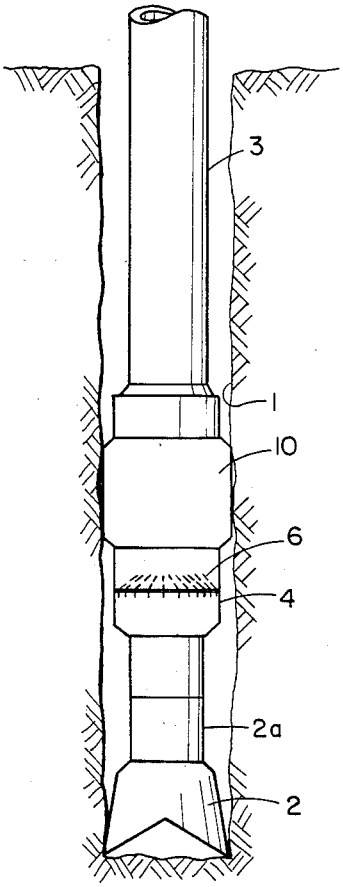
FIG. 1 is an elevational view of a well drilling apparatus embodying this invention, shown within a well bore prior to effecting any adjustment in the change of direction of the drilling apparatus.

Referring to FIG. 1, there is schematically illustrated the major components of a drilling apparatus employed in drilling a well bore 1. Such apparatus includes a conventional rotary drill bit 2 which is driven by a shaft of a suitable downhole motor 3. Normally, motor 3 is of the fluid pressure turbine type and is of substantial axial length. A stabilizer 10 is mounted in surrounding relationship to the downhole motor.

Figure 3:
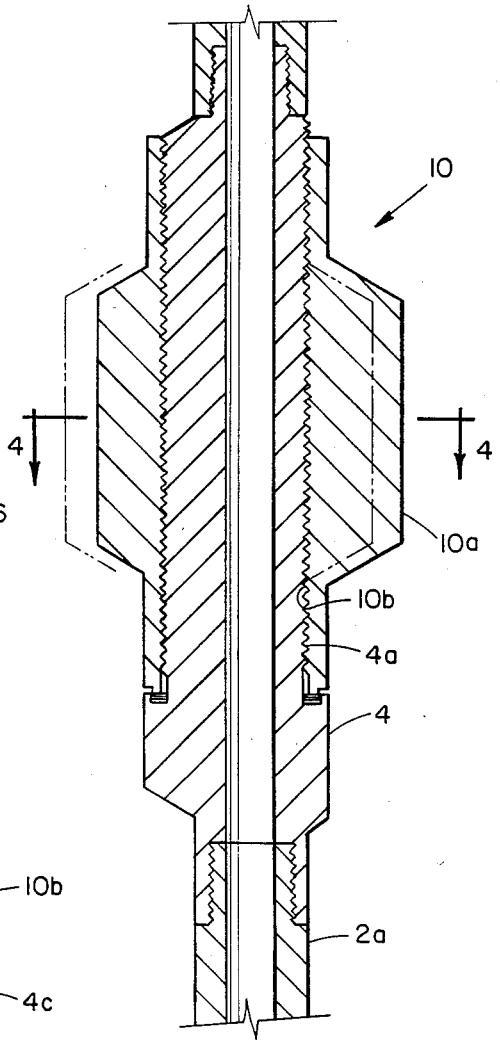
FIG. 3 is an enlarged scale vertical, sectional view of the directional adjusting apparatus embodying this invention incorporated in the apparatus of FIG. 1, with the dotted lines indicating an alternate position of the adjustable elements to produce a change in drilling direction.
Figure 5:
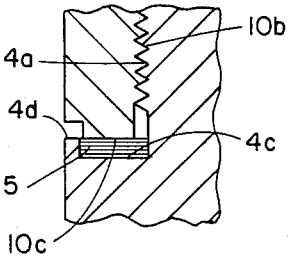
FIG. 5 is an enlarged scale partial sectional view illustrating the mounting of the adjusting shims.
Figure 6:
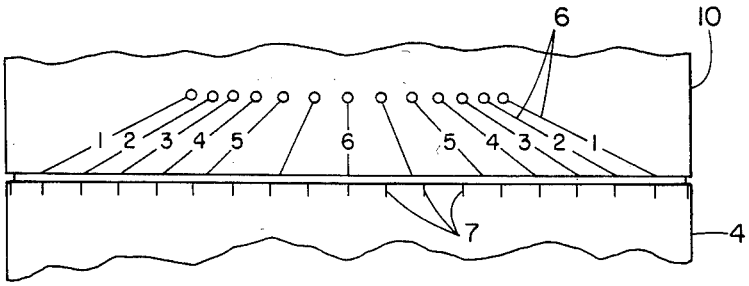
FIG. 6 is an enlarged scale, developed view illustrating the provision of angular adjustment indicia on the apparatus of FIG. 3.
Figure 4:
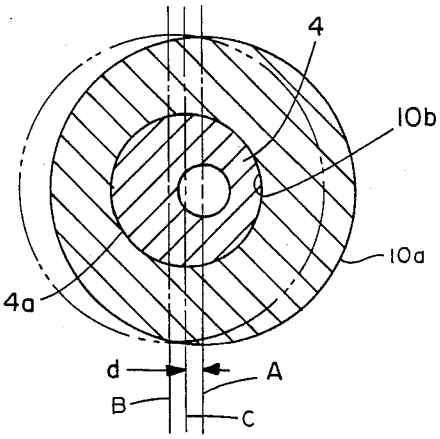
FIG. 4 is a sectional view taken on the plane 4—4 of FIG. 3.

As best shown in FIG. 3, the stablizer housing or guide sleeve 10 comprises a tubular member having a cylindrical external surface 10*a* dimensioned to snugly fit within the freshly drilled bore hole 1. Stabilizer housing 10 is, however, provided with an internal, generally cylindrical bore 10*b* which is eccentric by a slight distance "d" relative to the external cylindrical surface 10*a*. The degree of eccentricity is illustrated in FIG. 4 wherein the line A indicates the common axis of the downhole motor 3, the drilling tool 2 and the external surface 10*a* of the stabilizer housing 10 in its congruent eccentric position while the axis B indicates the location of the longitudinal axis of the external surface 10*a* of the stabilizer housing 10 in its extreme position relative to the common axis of the downhole motor 3 and drilling tool 2. The body or member 4 is provided with an eccentric, generally cylindrical surface 4*a* which snugly cooperates with the internal eccentric bore surface 10*b*, the axis of these eccentric surfaces being the same.

Figure 2:
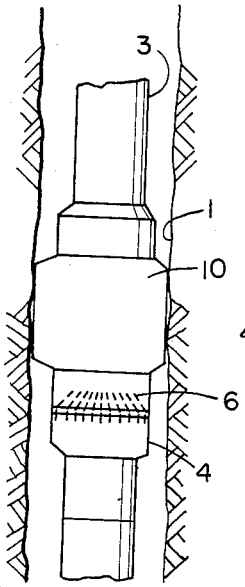
FIG. 2 is a view similar to FIG. 1 but showing the change in direction of the drilling apparatus accomplished by adjustment of the direction adjusting apparatus incorporating this invention.

Thus, if the stabilizer housing 10 is angularly shifted relative to the body or member 4, then a shift in the lateral position of the external surface 10*a* may be effected through a range of zero to two times the distance "d" shown in FIG. 4. Since the external surface 10*a* of the stabilizer 10 is in relatively snug engagement with the newly formed bore 1, it will be apparent that the cooperation of the two eccentric surfaces will produce a lateral shifting of the common rotational axis A of the rotary drilling tool 2 and the motor 3 as illustrated in FIG. 2.

It is, of course, necessary that the two cooperating eccentric elements be secured in any selected relative angular position. Such securement may, in accordance with the embodiment of this invention illustrated in FIGS. 1–6, be effected by providing the internal bore surface 10*b* with threads which cooperate with corresponding threads formed on the external eccentric surface 4*a*, as shown in FIG. 3. To permit the selective positioning of the stabilizer housing 10 in any desired angular relationship with respect to the body element 4, the degree of threaded interengagement of these two members may be controlled by the positioning of a selected number of thin annular, C-shaped shims 5 between cooperating radial surfaces 4*c* and 10*c* formed at an appropriate location respectively on the body element 4 and the stabilizer housing 10. The C-shaped shims 5 are preferably formed from a material that has at least the same resistance to compression as the materials from which the housing 10 and the body element 4 are fabricated so that the compressive load normally encountered in this connection will not result in any significant compressive deformation of such shims which would permit the loosening of the threaded connection between housing 10 and torque transmitting element 4. If desired, an upstanding annular flange 4*d* may be provided on the body in surrounding relationship to the abutment surface 4*c* to retain the C-shaped shims 5 in their desired position.

The extent of angular displacement of the stabilizer housing 10 with respect to the body element 4 may be conveniently indicated by indicating lines 6 provided on the exterior surface of the stabilizer housing 10 and by angularly spaced indicating marks 7 provided on the adjacent surface of the body element 4. The numbers provided for each of the angularly sloped lines 6 may preferably be numbered to indicate inches of lateral offset produced by a selected angular relationship of stabilizer housing 10 and body element 4.

Figure 7:
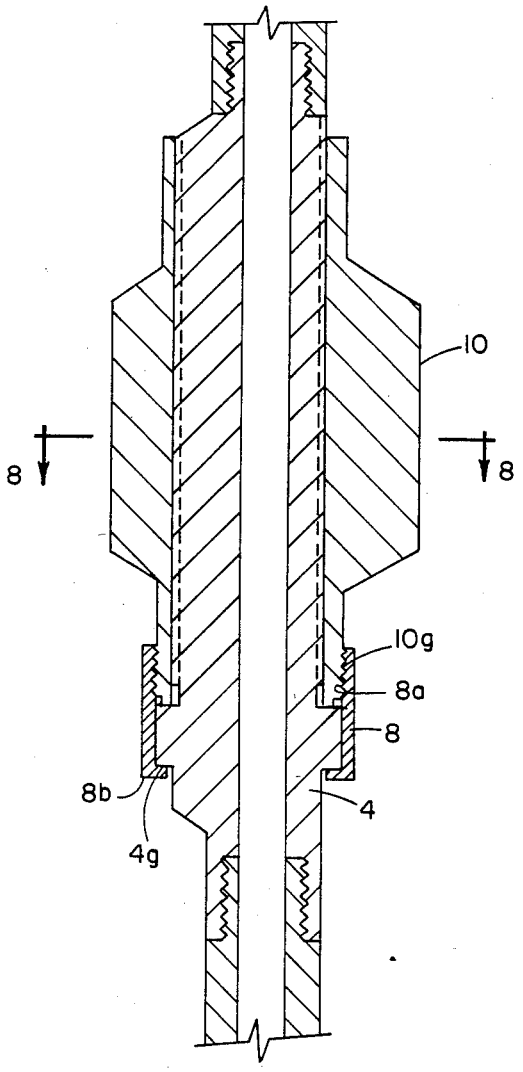
FIG. 7 is a vertical sectional view of a modified form of this invention wherein the angularly adjustable elements are interconnected by a plurality of peripherally spaced, axially extending splines.
Figure 8:
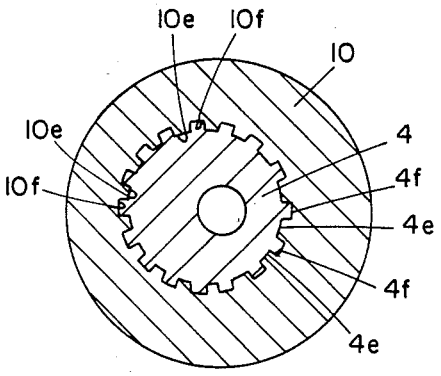
FIG. 8 is a sectional view taken on the plane 8—8 of FIG. 7.

Referring now to FIGS. 7 and 8, there is shown a modification of this invention wherein the cooperating eccentric male and female surfaces respectively provided on the body element 4 and the stabilizer housing 10 comprise cylindrical surfaces 4*e* and 10*e* having a plurality of peripherally spaced, axially extending flanges 4*f* and 10*f* which may be interengaged in any selected one of a plurality of angularly spaced positions of the stabilizer housing 10 and the body element 4.

To secure the housing 10 against axial movement relative to the body element 4, either the upper or lower portion of the housing 10 is provided with external threads 10*g* which cooperate with internal threads 8*a* provided on a locking sleeve 8 which has an internal flange 8*b* cooperating with a radial shoulder 4*g* formed on the body element 4.

While this invention may be conveniently practiced by mounting the stabilizer housing on the body as described, it will be equally effective when mounted on any eccentrically formed cylindrical surface provided on the motor element 3. Accordingly, the term "body" employed in the claims is not to be construed as limited to an actual sleeve separate and independent from the housing of motor 3.

It will be readily apparent to those skilled in the art that the operational procedures involved in adjusting the apparatus to effect a change in direction of the rotary drilling tool 2 can be quickly and accurately performed by the drill crew on the floor of the drilling rig. Moreover, a visual indication of the selected directional change is provided by indicia scribed on or otherwise suitably mounted on the adjacent surfaces so that no measurements are required on the part of the drilling operator.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for inclusion in the drive mechanism for a rotary well tool for effecting a lateral displacement of the rotary axis of the rotary tool relative to the previously drilled well bore, comprising, in combination: a member concentrically mountable relative to the output shaft of a downhole motor for the rotary tool; said member having a generally cylindrical external surface having an axis parallel to but laterally offset by a first distance from the rotary axis of the output shaft; a hollow housing having a generally cylindrical bore surface engagable with said generally cylindrical external surface of said member and an external cylindrical guide surface engageable with the wall of the well bore; the axis of said generally cylindrical guide surface being parallel to and laterally offset from the axis of said generally cylindrical bore surface by a selected distance; and means for securing said hollow housing in any selected angular position relative to said member, thereby laterally displacing the rotary tool relative to the bore hole by a selected distance.

2. The apparatus of claim 1 wherein said selected distance is substantially equal to said first distance.

3. The apparatus of claim 1 wherein the selected distance is from about zero to about two times that of said first distance.

4. The apparatus of claim 1 wherein said means for securing said hollow housing in any selected angular position relative to said member comprises cooperating threads on said generally cylindrical external surface of said member and said generally cylindrical bore of said hollow housing, and means for adjusting the extent of thread engagement of said cooperating threads.

5. The apparatus of claim 4 further comprising a pair of generally radial surfaces respectively provided on said member and said hollow housing and abuttable to limit the threaded engagement of said cooperating threads, and shims insertable between said member and said hollow housing to adjust their relative angular position when said threads are tightened to clamp said shims.

6. The apparatus of claim 1 wherein said means for securing said hollow housing in any selected angular position relative to said member comprises a plurality of peripherally spaced, axially extending splines on said generally cylindrical external surface of said member selectively cooperable with a plurality of peripherally spaced, axially extending grooves in said generally cylindrical bore of said hollow housing; and detachable means for preventing relative axial movements of said hollow housing and said member.

7. An apparatus for inclusion in the drive mechanism for a rotary well tool for effecting a lateral displacement of the rotary axis of the rotary tool relative to the previously drilled well bore, comprising, in combination: a body element concentrically mountable relative to the output shaft of a downhole motor for the rotary tool; said element having a generally cylindrical external surface having an axis parallel to but laterally offset from the rotary axis of the output shaft; a hollow housing having a generally cylindrical bore surface engagable with said generally cylindrical external surface of said element and an external cylindrical guide surface engagable with the wall of the well bore; the axis of said generally cylindrical guide surface being parallel to and laterally offset from the axis of said generally cylindrical bore surface; and means for securing said hollow housing in any selected angular position relative to said element, thereby laterally displacing the rotary tool relative to the bore hole by a selected distance.

* * * * *